US007181803B2

(12) United States Patent
Park et al.

(10) Patent No.: US 7,181,803 B2
(45) Date of Patent: Feb. 27, 2007

(54) DUAL FILTER, UPRIGHT VACUUM CLEANER WITH DETACHABLE HOSE

(75) Inventors: Jung-seon Park, Gwangju (KR); Hyung-il Jeon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 597 days.

(21) Appl. No.: 10/674,162

(22) Filed: Sep. 29, 2003

(65) Prior Publication Data

US 2004/0261214 A1 Dec. 30, 2004

(30) Foreign Application Priority Data

Jun. 26, 2003 (KR) ..... 10-2003-0042061

(51) Int. Cl.
*A47L 9/16* (2006.01)

(52) U.S. Cl. ..... 15/334; 15/352; 15/353; 55/DIG. 3; 55/337

(58) Field of Classification Search ..... 15/328, 15/334, 347, 352, 353; 55/337, 429, DIG. 3
See application file for complete search history.

(56) References Cited

U.S. PATENT DOCUMENTS

| | | | | |
|---|---|---|---|---|
| 3,320,727 | A * | 5/1967 | Forney et al. | 55/337 |
| 5,230,722 | A * | 7/1993 | Yonkers | 55/337 |
| 6,003,196 | A | 12/1999 | Wright et al. | 15/353 |
| 6,484,350 | B2 * | 11/2002 | Yung | 15/353 |
| 6,532,620 | B2 | 3/2003 | Oh | 15/353 |
| 6,732,406 | B2 | 5/2004 | Oh | 15/352 |
| 6,818,032 | B2 * | 11/2004 | Bilek et al. | 55/337 |
| 6,840,972 | B1 * | 1/2005 | Kim | 55/337 |
| 6,951,045 | B2 * | 10/2005 | Thur et al. | 15/334 |
| 2003/0037406 | A1 | 2/2003 | Wright et al. | 15/353 |
| 2004/0181898 | A1 * | 9/2004 | Kondo | 15/353 |

FOREIGN PATENT DOCUMENTS

| | | |
|---|---|---|
| GB | 2362341 | 11/2001 |
| GB | 2363319 | 12/2001 |
| GB | 2363744 | 1/2002 |
| GB | 2368002 | 4/2002 |
| GB | 2368005 | 4/2002 |
| GB | 2370978 | 7/2002 |
| GB | 2378125 | 2/2003 |

* cited by examiner

*Primary Examiner*—Theresa T. Snider
(74) *Attorney, Agent, or Firm*—Ladas & Parry LLP

(57) ABSTRACT

An upright type vacuum cleaner having a small sized cyclone dust collecting apparatus and dust bag in a dust collecting chamber comprises a main body including the dust collecting chamber having an air inlet and an air outlet, and a motor driving chamber in fluid communication with the air outlet, a suction brush mounted adjacent the main body of the vacuum cleaner, a cyclone dust collecting apparatus detachably mounted on the main body of the vacuum cleaner and having a path connected to the air inlet of the dust collecting chamber for discharging a cleaned air, and a dust bag detachably disposed in the dust collecting chamber to collect the dust and filth separated from an air drawn in through the suction brush.

14 Claims, 6 Drawing Sheets

DUAL FILTER, UPRIGHT VACUUM CLEANER WITH DETACHABLE HOSE

BACKGROUND OF THE INVENTION

1. Field of the Invention

The present invention relates generally to vacuum cleaners, and more specifically to upright type vacuum cleaners having a cyclone dust collecting apparatus detachably mounted along a path between a dust collecting chamber, including a dust bag, and a suction brush.

2. Description of the Related Art

Generally, a vacuum cleaner comprises a suction brush disposed adjacent a lower portion of a main body of the vacuum cleaner and is configured to be moved along a surface to be cleaned. The inside of the main body of the vacuum cleaner is normally partitioned into a dust collecting chamber and a motor driving chamber. A dust bag is removably disposed in the dust collecting chamber, and a motor is disposed in the motor driving chamber.

When the motor is driven in the above-described structure, a strong suction force is generated at the suction brush. The air, containing entrained dust and filth, is drawn from the surface to be cleaned into the cleaner body by the suction force. The air is discharged after filtering and passing through the dust bag in the dust collecting chamber of the main body of the vacuum cleaner. The dust and filth in the air is collected in the dust bag and the filtered air is discharged to the outside through the motor driving chamber.

According to the vacuum cleaner having the above-described structure, in which the dust and filth is collected only in the dust bag, because the dust bag is a consumable material, frequent changes of the dust bag are required. Therefore, an upright vacuum cleaner having a structure which enables extending of the usable life cycle of the dust bag and which improves the efficiency of dust collecting, is required.

SUMMARY OF THE INVENTION

The present invention has been made to overcome the above problems, and an object of the present invention is to provide an upright vacuum cleaner having an improved structure so as to extend the useful life cycle of a dust bag and to enhance dust collecting efficiency of the vacuum cleaner.

To accomplish the above objects, the vacuum cleaner according to the present invention, comprises a main body including a dust collecting chamber having an air inlet and an air outlet, and a motor driving chamber in fluid communication with the air outlet; a suction brush mounted adjacent the main body of the vacuum cleaner for drawing in air having entrained contaminants found on a surface to be cleaned, with the suction brush being configured to come into contact with the surface to cleaned, a cyclone dust collecting apparatus detachably mounted on the main body of the vacuum cleaner and having a path connected to the air inlet of the dust collecting chamber for discharging a cleaned air, and a path forming member connecting the cyclone dust collecting apparatus and the suction brush for guiding the air drawn in through the suction brush to the cyclone dust collecting apparatus.

According to a preferred embodiment of the present invention, the cyclone dust collecting apparatus comprises a cyclone body having a cyclone air inlet connected to the path forming member and a cyclone air outlet connected to the air inlet of the dust collecting chamber, for guiding the air drawn in through the cyclone air inlet so as to form a vortex current, and a dust receptacle removably coupled to the cyclone body for collecting the contaminants, such as dust and filth, separated by a centrifugal force of the vortex current of the drawn air.

The cyclone dust collecting apparatus further comprises a grill disposed in the dust receptacle, and the grill has a plurality of through holes for preventing the air entrained with contaminants from flowing into the cyclone air outlet.

are A first receiving depression is formed at a rear side of the main body of the vacuum cleaner, on which the cyclone body is mounted and a second receiving depression is formed at the rear side, on which the dust receptacle is mounted.

The cyclone body further comprises a duct at one end thereof connected to the air inlet of the dust collecting chamber at another end connected to the cyclone air outlet, and a fixing unit detachably coupling the cyclone dust collecting apparatus to the main body of the vacuum cleaner.

The duct has a bent portion between a first coupling portion connected to the cyclone air outlet and a second coupling portion connected to the air inlet.

The fixing unit further comprises a coupling projection formed at the first receiving depression, and a coupling recess formed in the duct at a position corresponding to the coupling projection.

Preferably, the path forming member is a flexible hose.

Meanwhile, according to the another embodiment of the present invention, an upright vacuum cleaner comprises a main body including a dust collecting chamber having an air inlet and an air outlet, and a motor driving chamber in fluid communication with the air outlet, a suction brush mounted adjacent the main body of the vacuum cleaner for drawing in contaminant laden air located on a surface to be cleaned, with the suction brush being shaped and configured to come into contact with the surface to be cleaned, a cyclone dust collecting apparatus, detachably mounted at a rear side of the main body of the vacuum cleaner, and having a cyclone body for guiding the air drawn in through the suction brush and being shaped and configured to form a vortex air current, a dust receptacle detachably coupled to the cyclone body, and a grill disposed in the dust receptacle, and a flexible hose connected between the cyclone dust collecting apparatus and the suction brush for guiding the air drawn in through the suction brush to the cyclone dust collecting apparatus. The cyclone dust collecting apparatus is mounted so that the dust and filth from the air drawn in through the suction brush is separated in the cyclone dust collecting apparatus in a primary filtering operation and is separated in the dust collecting chamber of the main body of the vacuum cleaner in a secondary filtering operation. Alternatively, the cyclone dust collecting apparatus is detached and removed form the hose and the flexible hose is connected directly to the main body of the vacuum cleaner.

At a rear side of the main body of the vacuum cleaner a first receiving depression is formed on which the cyclone body is mounted and a second receiving depression is formed on which the dust receptacle is mounted.

The cyclone body comprises a duct connected at one end thereof to the air inlet of the dust collecting chamber, and a fixing unit detachably coupling the cyclone dust collecting apparatus to the main body of the vacuum cleaner. Preferably, the duct has a bent portion disposed between a first coupling portion, connected to the cyclone air outlet, and a second coupling portion, connected to the air inlet.

The fixing unit comprises a coupling projection formed at the first receiving depression, and a coupling recess formed in the duct at a position corresponding to the coupling projection.

BRIEF DESCRIPTION OF THE DRAWING FIGURES

The aforementioned objects and features of the present invention will become more apparent by achieving an understanding of the preferred embodiments of the present invention by referring to the accompanying drawings, in which.

DETAILED DESCRIPTION OF THE PREFERRED EMBODIMENTS

Hereinafter, referring to the accompanying drawings, an upright vacuum cleaner will be illustrated according to an embodiment of the present invention.

Figure 1:
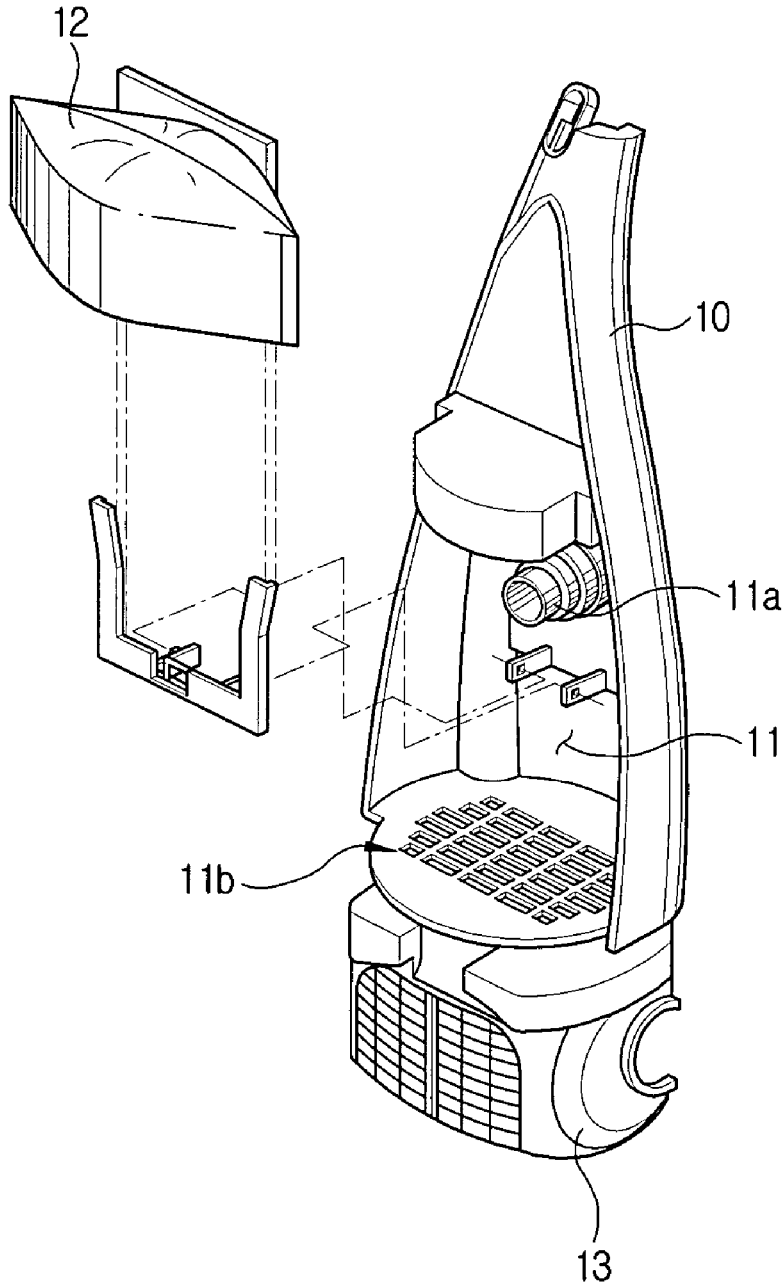
FIG. 1 is a perspective view showing a partially exploded upright vacuum cleaner main body according to the present invention.
Figure 2:
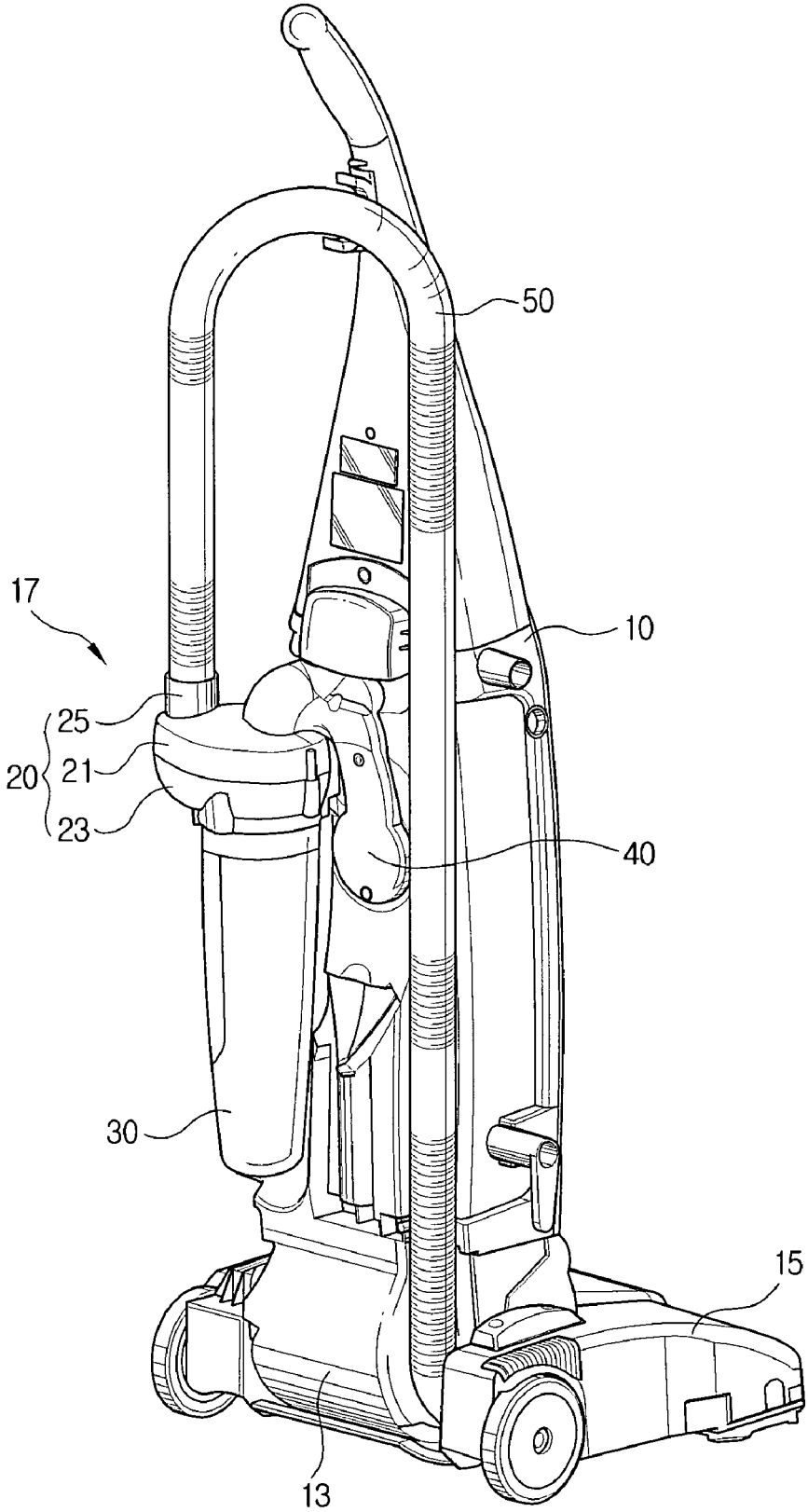
FIG. 2 is a perspective view showing the upright vacuum cleaner according to the present invention from the rear.

Referring to FIGS. 1 and 2, the upright vacuum cleaner according to the embodiment of the present invention comprises a main body 10 of the vacuum cleaner having a dust collecting chamber 11 and a motor driving chamber 13, a suction brush 15 removably disposed adjacent the main body 10 of the vacuum cleaner, a dust bag 12 for separating and collecting contaminants, such as dust and filth, from air drawn in through the suction brush 15, and a cyclone dust collecting apparatus 17, removably disposed at a rear portion of the main body 10 of the vacuum cleaner.

The dust collecting chamber 11 comprises an air inlet 11*a* connected with an air suction pipe 50 (FIG. 2) to the suction brush 15, and an air outlet 11*b* (FIG. 1) connected to the motor driving chamber 13. Preferably, the air inlet 11*a* is formed adjacent an upper portion of an inner wall of the dust collecting chamber 11, and the air outlet 11*b* is formed adjacent a bottom side of the inner wall of the dust collecting chamber 11.

The cyclone dust collecting apparatus 17 centrifugally separates and collects the dust and filth entrained in the air drawn in through the suction brush 15. The cyclone dust collecting apparatus 17 comprises a cyclone body 20 and a dust receptacle 30 removably coupled to the cyclone body 20.

Figure 4:
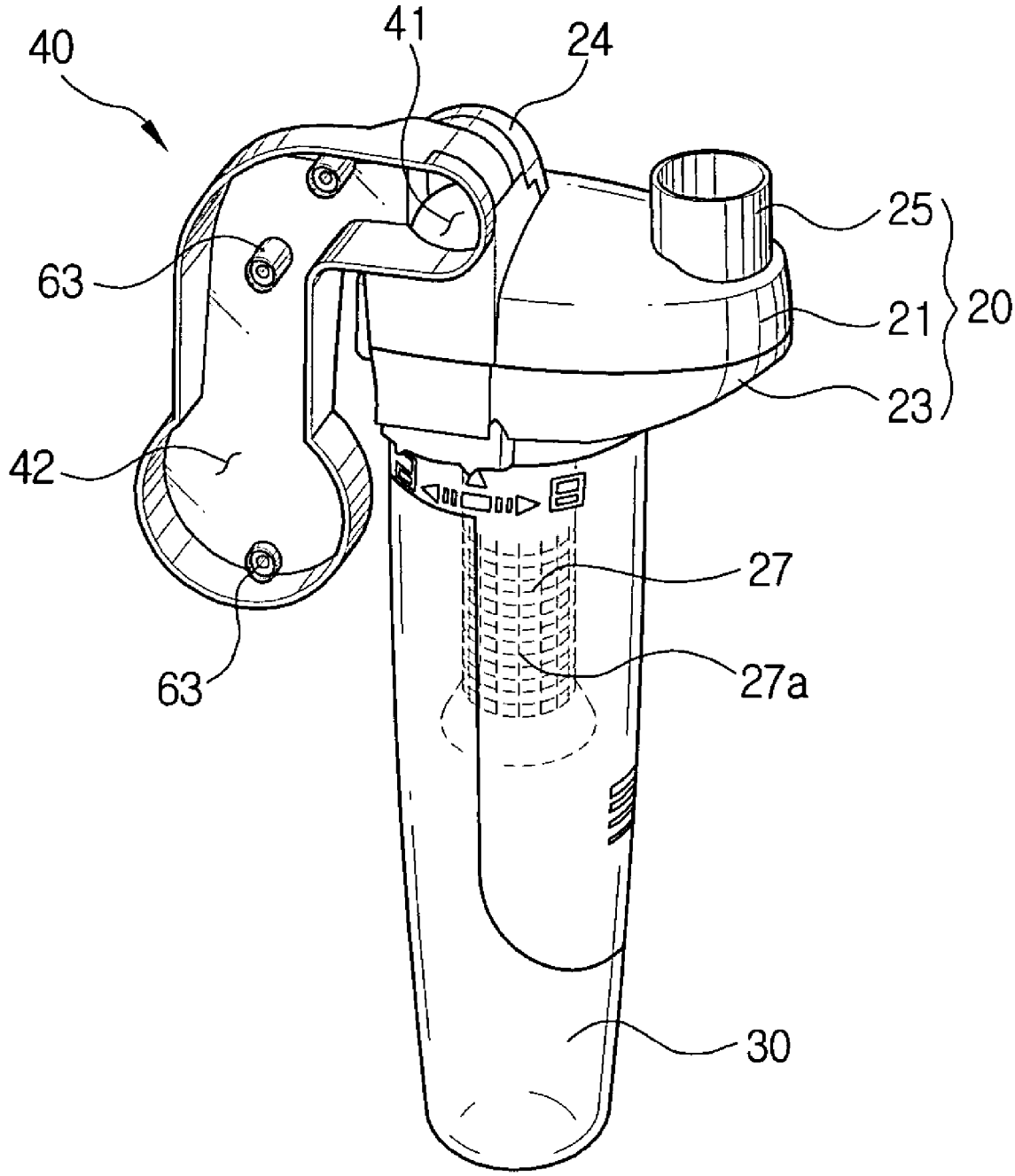
FIG. 4 is a perspective detail view showing the cyclone dust collecting apparatus having a duct according to the present invention.

The cyclone body 20, as shown in greater detail in FIG. 4, comprises an upper body 21 and a lower body 23 secured to the upper body 21 with a screw or other appropriate attachment means. The upper body 21 is coupled with a duct 40 and is provided with a cyclone air inlet 25 in fluid communication with the suction brush 15 by the air suction pipe 50 which will be described below. One end of the duct 40 is connected to the air inlet 11*a* and the other end thereof is connected to a cyclone air outlet 24 formed at the cyclone dust collecting apparatus 17 (FIG. 2).

The cyclone body 20 having the above-described structure guides the air, including the entrained dust, which is drawn in through the cyclone inlet 25, so that the air forms a vortex current or cyclone. The dust receptacle 30 collects the dust and filth which is separated from the air by the centrifugal force of the vortex current.

The cyclone body 20 may further comprise a grill 27 disposed in the dust receptacle 30. The grill 27 is preferably formed having a cylindrical shape extended downwardly from the dust receptacle 30 to a desired portion so that the air having the entrained dust is prevented from flowing into the cyclone air outlet 24. Furthermore, fine through holes 27*a* are formed on an outer surface of the grill 27. The grill 27 also prevents direct fluid communication between the cyclone air outlet 24 and the cyclone air inlet 25, except through the fine through holes 27*a*.

The duct 40 is mounted at the cyclone body 20 with one end connected to the air inlet 11*a* and the other end connected to the cyclone air outlet 24, as aforementioned. The duct 40 may further comprise a fixing unit 60 (FIG. 3) for detachably coupling the cyclone dust collecting apparatus 17 to the main body 10 of the vacuum cleaner.

Figure 3:
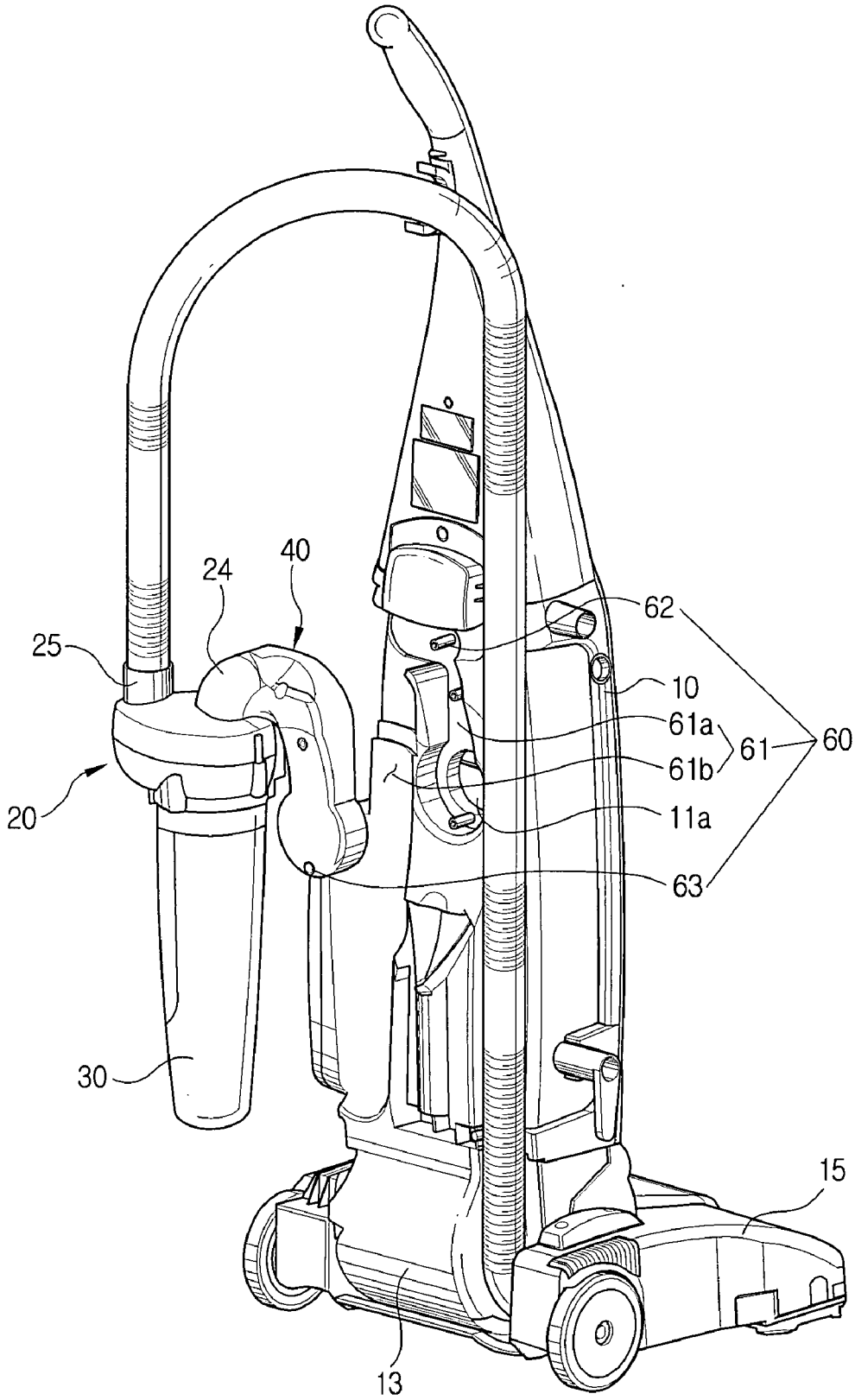
FIG. 3 is a perspective view showing important features of the cyclone dust collecting apparatus of FIG. 2, including a duct and a main body of the vacuum cleaner.

As shown in FIGS. 3 and 4, the duct 40 is preferably formed in such a manner that there is a bent portion disposed between a first coupling portion 41, connected to the cyclone air outlet 24, and a second coupling portion 42, connected to the air inlet 11*a*. That is, the first and second coupling portions 41, 42 are connected along an indirect path, to thereby attenuate noise occurring from radical change of pressure between the inlet 11*a* and outlet 24.

At a rear wall of the main body 10 of the vacuum cleaner there is provided a receiving depression 61 upon which the cyclone dust collecting apparatus 17, coupled with the duct 40, is mounted. The receiving depression 61 preferably includes a first receiving depression 61*a*, on which the cyclone body 20 is mounted, and a second receiving depression 61*b*, on which the dust receptacle 30 is mounted.

Accordingly, the fixing unit 60 for detachably coupling the cyclone dust collecting apparatus 17 to the main body 10 of the vacuum cleaner comprises the first and second receiving depression 61*a*, 61*b*, at least one coupling projection 62 disposed in the first receiving depression 61*a*, and at least one coupling recess 63 formed in the duct 40 at a position corresponding to each coupling projection 62. Locations of the coupling projections 62 and coupling recesses 63 are preferably complementary.

The user can the attach the cyclone dust collecting apparatus 17 to the main body 10 of the vacuum cleaner in a simple way by fitting the coupling projection 62 protruding on the first receiving depression 61*a* into the coupling recess 63 in the duct 40, as shown in FIGS. 3 and 4, with the first receiving depression 61*a* formed at a rear side of the main body 10 of the vacuum cleaner having a shape corresponding to the duct 40 being mounted to the cyclone dust collecting apparatus 17. Also the user can detach the cyclone dust collecting apparatus 17 from the main body 10 of the vacuum cleaner in the reverse operation by dismounting the apparatus 17 when removing the recess 63 from the projection 62. Since each shape of the first and second receiving depressions 61*a*, 61*b* corresponds to external shapes of the duct 40 being mounted to the cyclone dust collecting apparatus 17 and the dust receptacle 30, respectively, the cyclone dust collecting apparatus 17 becomes closely contacting with the main body 10 of the vacuum cleaner.

Figure 5:
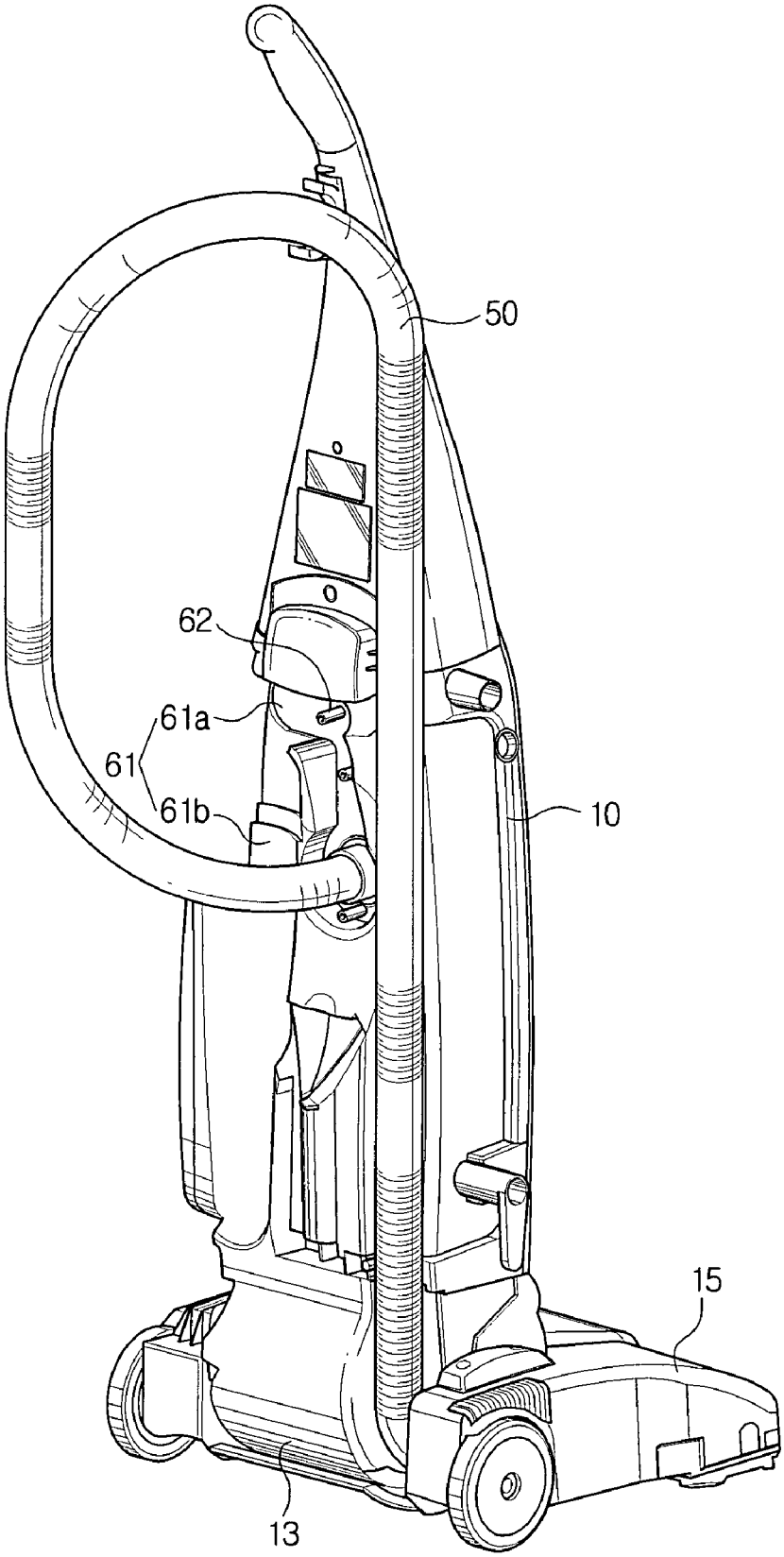
FIG. 5 is a perspective view showing a flexible hose with one end directly connected to the dust collecting chamber according to another embodiment of the present invention.

The cyclone dust collecting apparatus 17 is in fluid communication with the suction brush 15 through the air suction nine 50. The air suction pipe 50 may employ a flexible hose which is connected at one end to the suction brush 15 and connected at another end to the cyclone air inlet 25. Alternatively, when the cyclone dust collecting apparatus 17 is separated from the main body 10 of the vacuum cleaner, one end of the flexible hose may be connected directly to the air inlet 11*a* of dust collecting chamber 11 in the main body 10 of the vacuum cleaner, as shown in FIG. 5.

Figure 6:
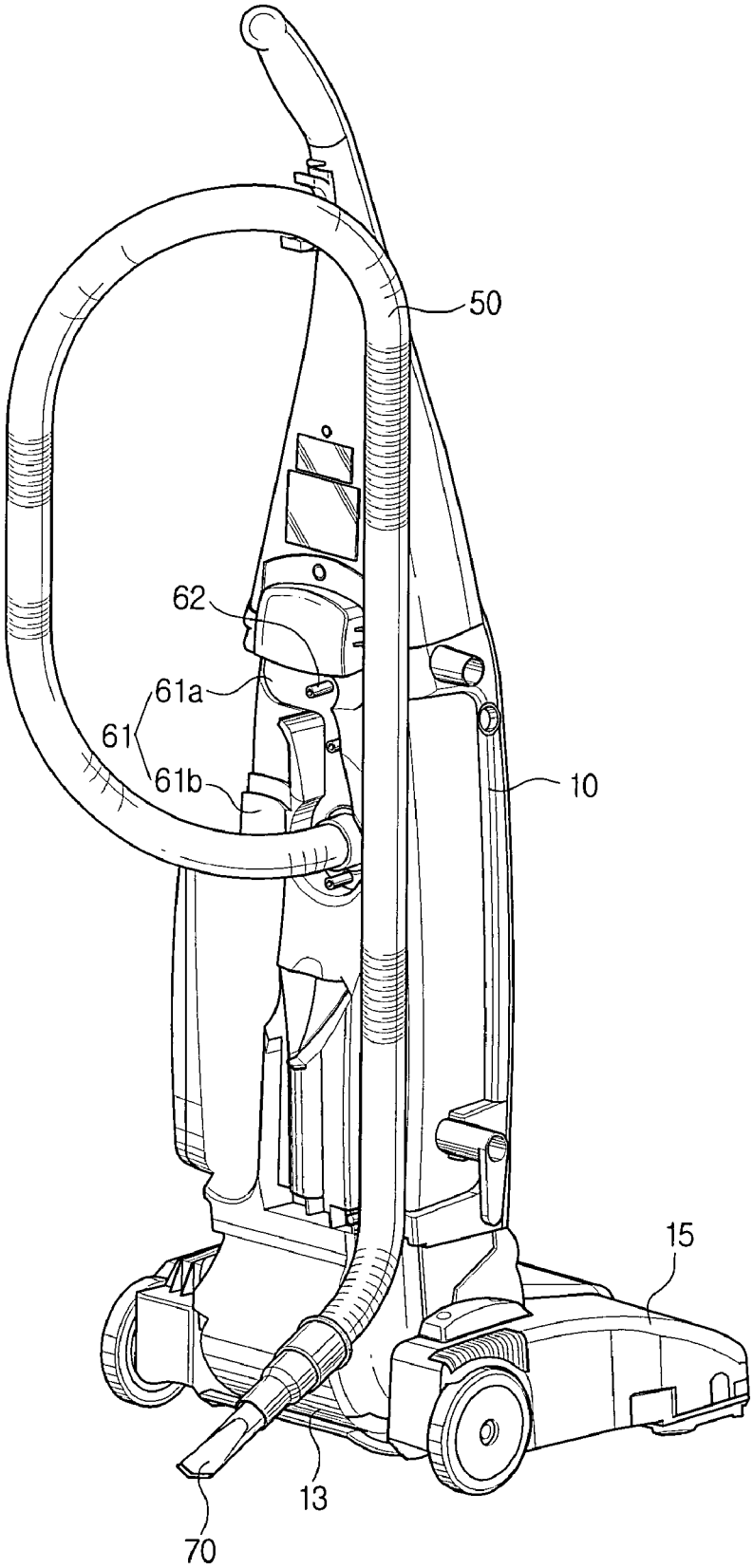
FIG. 6 is a perspective view showing the flexible hose with one end connected to an auxiliary brush according to another embodiment of the present invention.

Also, when the cyclone dust collecting apparatus 17 is separated from the main body 10 of the vacuum cleaner, an auxiliary brush 70 may be connected to one end of the flexible hose, as shown in FIG. 6.

Hereinafter, the operation of an upright vacuum cleaner having the above-described structure will be described in detail according to the embodiment of the present invention.

When the power is supplied to a motor (not shown) in the motor driving chamber 13, a suction force is generated by the motor. Air, containing entrained dust and filth located on the surface to be cleaned, is drawn into the suction brush 15 by the suction force, and is introduced into the cyclone body 20 through the cyclone air inlet 25. The drawn air is guided to form the vortex current due to the shape and structure of the cyclone body 20 and of the dust receptacle 30. As the air descends to the bottom side of the dust receptacle 30, the dust and filth is separated from the air by the centrifugal force of the vortex current and is collected in the dust receptacle 30.

The vortex air current in the dust receptacle 30, once it reaches the downward terminus of receptacle 30, is reflected by the bottom of the dust receptacle 30, and begins to ascend upwardly. The ascending air current is guided to the cyclone air outlet 24 and enters the fine through holes 27*a* and the center hole of the grill 27 (shown in phantom in FIG. 3). At this time, clean air, disposed around the center portion of the dust receptacle 30, is discharged directly through the center hole of the grill 27. On the other hand, air containing fine dust ascends upwardly along an outer circumference of the dust receptacle 30, as a result of centrifugal action, the large pieces of dust and filth entrained in the air are caught at the through holes 27*a* Therefore, the dust and filth does not flow into the air outlet 24 but falls down into the dust receptacle 30, where it is collected, and the cleaned air only is discharged through the fine through holes 27*a*.

The air discharged through the cyclone air outlet 24 is directed to the air inlet 11*a* in the dust collecting chamber 11 via the duct 40 which is coupled to the cyclone dust collecting apparatus 17. The dust bag (FIG. 1) 12 filters the air once again for the very fine dust, which has not been filtered in the cyclone dust collecting apparatus 17. The clean air filtered by the dust bag 12 is directed to the motor driving chamber 13 via the air outlet 11*a* in the dust collecting chamber 11 and is discharged to the outside.

Accordingly, the dust and filth is filtered two times by the cyclone dust collecting apparatus 17 and the dust bag 12 sequentially, to thereby improve the dust collecting efficiency. Also, the life cycle of the consumable dust bag 12 is extended, since the cyclone dust collecting apparatus 17 previously filters larger pieces of dust and filth before they reach the dust bag.

At the user's choice, the cyclone dust collecting apparatus 17 may be attached to and detached from the main body 10 of the vacuum cleaner. When separating the dust collecting apparatus 17 from the main body 10 of the vacuum cleaner, e.g., for maintenance thereof, one end of the path forming member 50, which was connected to the cyclone air inlet 25, may be connected directly to the dust collecting chamber 11 as shown in FIG. 5.

The cyclone dust collecting apparatus 17 is in fluid communication with the suction brush 15 through the air suction pine 50 employing the flexible hose. When dust and filth is found in a narrow space or located on a high surface, the cleaning operation may be conducted by separating the air suction pipe 50 from the suction brush 15 and connecting the auxiliary brush 70 thereto, as shown in FIG. 6.

With the upright vacuum cleaner according to the present invention, the small sized cyclone dust collecting apparatus separates and collects the dust and filth in a primary filtration step and so extends the life cycle of the dust bag 12. Also, since the vacuum cleaner employs the cyclone type dust collecting apparatus providing for dust collecting with high efficiency, as well as the dust bag, in sequential filtering steps, the quantity of the collected dust increases and the user convenience is also improved.

While the present invention has been shown and described with reference to the preferred embodiments thereof, the present invention is not limited to the preferred embodiments described herein. It will be understood by those skilled in the art that various changes in form and details may be made therein without departing from the sprit and scope of the invention as defined by the appended claims. Therefore, all of such appropriate changes and modifications and the equivalents should be considered to be within the scope of the present invention, as defined by the following claims and equivalents thereof.

What is claimed is:

1. An upright vacuum cleaner comprising:

a main body including a dust collecting chamber having a dust filter, said dust filter having an air inlet and an air outlet, and a motor driving chamber in fluid communication with the air outlet of said dust filter to draw air through said dust filter from said dust filter air inlet;

a suction brush mounted on the main body of the vacuum cleaner to draw in air with entrained contaminants found on a surface to be cleaned, the suction brush being configured to contact the surface to be cleaned;

a cyclone dust collecting apparatus detachably mounted in a path between the suction brush and the air inlet of the dust filter, said cyclone dust collecting apparatus separating and collecting the dust and filth from the air drawn in through the suction brush;

a removable air suction pipe, connecting the cyclone dust collecting apparatus and the suction brush, said removable air suction pipe guiding air drawn in through the suction brush to the cyclone dust collecting apparatus, when said cyclone dust collecting apparatus is attached to the main body, said removable air suction pipe guiding air drawn into the suction brush into the dust filter when the cyclone dust collecting apparatus is detached from the main body and said removable air suction pipe is attached to the main body.

2. The vacuum cleaner of claim 1, wherein the cyclone dust collecting apparatus comprises:

a cyclone body having a cyclone air inlet connected to the air suction pipe and a cyclone air outlet connected to the air inlet of the dust filter, to guide the air drawn in through the cyclone air inlet so as to form a vortex current; and a dust receptacle, removably coupled to the cyclone body for collecting dust and filth separated by centrifugal force of a vortex current of the drawn air.

3. The vacuum cleaner of claim 2, wherein the cyclone dust collecting apparatus further comprises a grill disposed in the dust receptacle in fluid communication with the cyclone air outlet, the grill having a plurality of through holes to prevent contaminants entrained in the air from flowing into the cyclone air outlet.

4. The vacuum cleaner of claim 2, wherein a first receiving depression is formed at a rear side of the main body of the vacuum on which the cyclone body is mounted, and a second receiving depression is formed at the rear side on which the dust receptacle is mounted.

5. The vacuum cleaner of claim 2, wherein the cyclone body further comprises:

a duct connected at one end to the air inlet of the dust filter and connected at another end to the cyclone air outlet; and a fixing unit detachably coupling the cyclone dust collecting apparatus to the main body of the vacuum cleaner.

6. The vacuum cleaner of claim 5, wherein the duct has a bent portion between a first coupling portion connected to the cyclone air outlet and a second coupling portion connected to the air inlet of the dust filter.

7. The vacuum cleaner of claim 5, wherein the fixing unit further comprises:

a coupling projection formed at a first receiving depression; and a coupling recess formed in the duct at a position corresponding to the coupling projection.

8. The vacuum cleaner of claim 1, wherein the air suction pipe is a flexible hose.

9. An upright vacuum cleaner comprising:

a main body including a dust collecting chamber having a dust filter having an air inlet and an air outlet, and a motor driving chamber in fluid communication with the air outlet of the dust filter, a suction brush mounted adjacent the main body of the vacuum cleaner to draw in contaminant-laden air located on a surface to be cleaned, with the suction brush being configured to come into contact with the surface to be cleaned;

a cyclone dust collecting apparatus, having an air inlet and a cyclone air outlet, detachably mounted at a rear side of the main body of the vacuum cleaner, having a cyclone body for guiding the air drawn in through the suction brush and being shaped and configured to form a vortex air current, and a dust receptacle detachably coupled to the cyclone body, and a grill disposed in the dust receptacle; and a detachable flexible hose connecting the cyclone dust collecting apparatus air inlet to the suction brush so as to guide the air drawn in through the suction brush to the cyclone dust collecting apparatus, when the cyclone dust collecting apparatus is mounted to the main body, so that dust and filth entrained in the air drawn in through the suction brush is separated in the cyclone dust collecting apparatus in a primary filtering operation and is further separated in the dust filter in the dust collecting chamber of the main body of the vacuum cleaner in a secondary filtering operation, and wherein when the cyclone dust collecting apparatus is detached from the main body and the flexible hose is attached to the main body, dust and filth entrained in the air drawn in through the suction brush is carried through the flexible hose into the dust filter in the dust collecting chamber of the main body of the vacuum cleaner.

10. The vacuum cleaner of claim 9, wherein a first receiving depression is formed at the rear side of the main body of the vacuum cleaner upon which the cyclone body is mounted and a second receiving depression is formed at the rear side upon which the dust receptacle is mounted.

11. The vacuum cleaner of claim 9, wherein the cyclone body further comprises:

a duct connected at one end to the air inlet of the dust collecting chamber; and a fixing unit detachably coupling the cyclone dust collecting apparatus to the main body of the vacuum cleaner.

12. The vacuum cleaner of claim 11, wherein the duct has a bent portion between a first coupling portion connected to the cyclone air outlet and a second coupling portion connected to the air inlet of the dust filter.

13. The vacuum cleaner of claim 11, wherein the fixing unit further comprises:

a coupling projection formed at a first receiving depression in the main body; and a coupling recess formed in the duct at a position corresponding to the coupling projection.

14. An upright vacuum cleaner comprising:

a main body including a dust collecting chamber having an air inlet and an air outlet, and a motor driving chamber in fluid communication with the air outlet;

a suction brush mounted adjacent the main body of the vacuum cleaner to draw in contaminant-laden air found on a surface to be cleaned, with the suction brush being configured to come into contact with the surface to be cleaned;

a cyclone dust collecting apparatus, detachably mounted at a rear side of the main body of the vacuum cleaner, having a cyclone body for guiding the air drawn in through the suction brush, and being shaped and configured to form a vortex air current, a dust receptacle detachably coupled to the cyclone body, and a grill disposed in the dust receptacle; and a flexible hose connecting the cyclone dust collecting apparatus and the suction brush so as to guide the air drawn in through the suction brush to the cyclone dust collecting apparatus;

wherein the cyclone dust collecting apparatus may be detached and the flexible hose may be connected directly to the main body of the vacuum cleaner, so that the dust and filth entrained in the air drawn in through the suction brush is separated in the dust collecting chamber of the main body of the vacuum cleaner.

* * * * *